United States Patent [19]

Ando et al.

[11] Patent Number: 4,597,926

[45] Date of Patent: Jul. 1, 1986

[54] METHOD OF MANUFACTURING RADIAL FLOW TURBINE ROTOR

[75] Inventors: Akio Ando, Kawasaki; Toshihiko Ochiai, Yokosuka; Masae Nakanishi, Chigasaki; Shozo Kawasaki; Katsutoshi Nishida, both of Yokohama, all of Japan

[73] Assignee: Tokyo Shibaura Denki Kabushiki Kaisha, Kawasaki, Japan

[21] Appl. No.: 711,092

[22] Filed: Mar. 13, 1985

Related U.S. Application Data

[62] Division of Ser. No. 430,000, Sep. 30, 1982, abandoned.

[30] Foreign Application Priority Data

Nov. 30, 1981 [JP] Japan ..... 56-190597

[51] Int. Cl.[4] ..... C04B 35/64

[52] U.S. Cl. ..... 264/67; 264/63; 416/241 B

[58] Field of Search ..... 264/67, 63; 416/188, 416/241 B, 244 A

[56] References Cited

U.S. PATENT DOCUMENTS

| | | | |
|---|---|---|---|
| 2,431,660 | 11/1947 | Gaudenzi | 416/241 B |
| 3,077,297 | 2/1963 | Clarke | 416/244 A |
| 3,133,505 | 5/1964 | Heerens et al. | 415/213 T |
| 3,430,898 | 3/1969 | Parechanian et al. | 416/241 B |
| 3,666,302 | 5/1972 | Kellett | 416/241 B |
| 4,175,911 | 11/1979 | Tiefenbacher | 416/241 B |
| 4,385,866 | 5/1983 | Ochiai et al. | 416/241 B |
| 4,408,959 | 10/1983 | Long et al. | 416/241 B |

FOREIGN PATENT DOCUMENTS

| | | |
|---|---|---|
| 1236779 | 6/1960 | France . |
| 2055982 | 3/1981 | United Kingdom . |

OTHER PUBLICATIONS

English Abstract of Motortechnische, Zeitschrift, vol. 39, No. 10, Oct. 1978, P. Walzer, "Keramische Bauteile für Fahrzeug-Gasturbinen".

*Primary Examiner*—James Derrington

*Attorney, Agent, or Firm*—Cushman, Darby & Cushman

[57] ABSTRACT

A method of manufacturing a radial flow turbine rotor is disclosed, which comprises the steps of injection molding a rotor body including a conical shaft and a plurality of blades formed on the periphery of the shaft and at an angle to the axis of the shaft from a ceramic material using a mold having parting lines corresponding to blade edges such that projections are formed on the blade edges, sintering the molding thus obtained, and grinding the edge surfaces of the blades facing a casing. The blades are thus provided with projections on their inlet and outlet edges which face a fluid passage.

5 Claims, 2 Drawing Figures

METHOD OF MANUFACTURING RADIAL FLOW TURBINE ROTOR

This is a division of application Ser. No. 430,000, filed Sept. 30, 1982, now abandoned.

BACKGROUND OF THE INVENTION

This invention relates to a radial flow turbine rotor used for a supercharger or the like using high temperature exhaust gas of an internal combustion engine as a drive source and a method of manufacturing the same.

Hitherto, an exhaust gas supercharger has been provided in an internal combustion engine in order to increase the density of air supplied for combustion and to increase the effective pressure of the combustion gas. A radial flow turbine rotor is usually provided in a combustion exhaust gas passage of the supercharger as mentioned. Usually, such a radial flow turbine rotor has a structure comprising a shaft and precision cast heat-resistant steel blades welded to the periphery of the shaft. The maximum permissible temperature of this radial flow turbine rotor is about 650° to 750° C., and the rotational speed is about 100,000 rpm. at most.

With such a radial flow turbine rotor, however, breakage is liable to result at the welded portion of the blade stem when high vibratory stress is produced at a high engine rpm. Further, with the supercharger it is desirable to increase the rpm by taking in high temperature and high pressure combustion exhaust gas and to reduce the stress acting on the blade stem as much as possible. To these ends, it is necessary to construct the entire apparatus with a material, which is light in weight and has excellent mechanical strength and thermal shock resistance. The conventional heat-resistant steels have not been perfectly satisfactory from these standpoints.

Recently ceramic turbine rotors have been developed. For example, a curved blade rotor made of ceramic material is shown at pages 888–891 of CERAMICS FOR HIGH PERFORMANCE APPLICATIONS-II published in 1978 by Brook Hill Publishing Company. The above-mentioned curved blade rotor was made by AME Ltd. in reaction bonded silicon nitride. The main object of making ceramic curved blade rotor is to replace expensive nickel alloys by cheaper, non-strategic materials and to operate the turbine at high temperatures. However, it has been found to be necessary to improve the design of the rotor in making a curved blade rotor of ceramic material.

The inventors have conducted various research and investigations and have found that the time required for finishing a radial flow turbine rotor after sintering can be reduced by obtaining a molding by injection molding using a mold having parting lines corresponding to the edges of blades said molding thus having no burrs on the periphery of the shaft to thereby enhance the efficiency of the turbine provided with the rotor.

SUMMARY OF THE INVENTION

The invention has an object of providing a radial flow turbine rotor, which can enhance the efficiency of a turbine and can be finished in a short time, and a method of manufacturing the same.

The radial flow turbine rotor according to the invention comprises a one-piece ceramic sintered body including a shaft and blades, with the blades having projections formed at their inlet and outlet edges facing a fluid passage. The method of manufacture according to the invention comprises the step of forming the body including the shaft and blades by injection molding from a ceramic material using a mold having a parting lines corresponding to the edges of blades, projections being formed on the edges of the blades at this time, sintering the molding thus formed and grinding the surfaces of the blade edges which are facing the casing.

DETAILED DESCRIPTION OF THE PREFERRED EMBODIMENT

Figure 1:
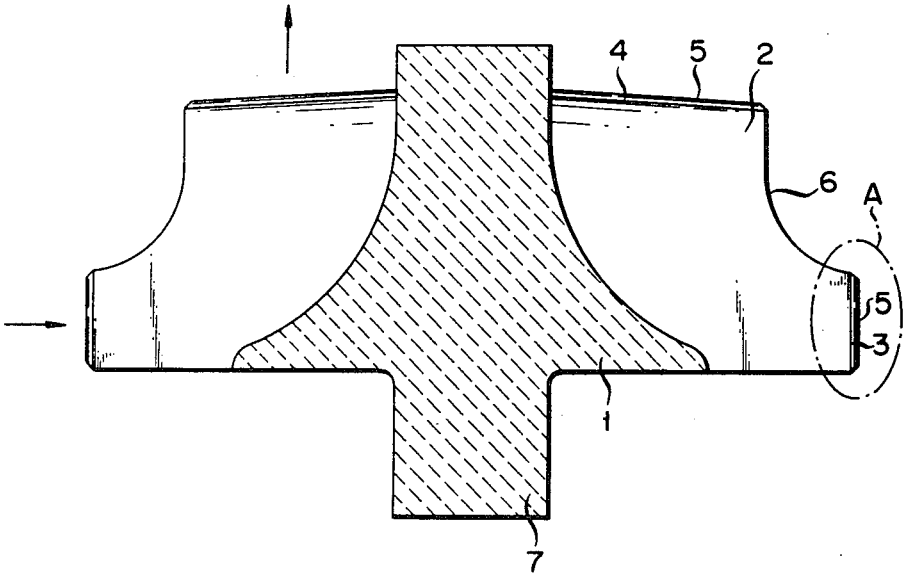
FIG. 1 is a longitudinal sectional view of a radial flow turbine rotor according to the invention.
Figure 2:
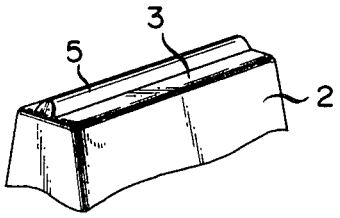
FIG. 2 is an enlarged perspective view of the part A of the rotor shown in FIG. 1.

A preferred embodiment of the invention will now be described in detail with reference to the drawing. Referring to the drawing, there is shown a radial flow turbine rotor, which comprises a conical shaft 1 and a plurality of blades 2 projecting from the periphery of the shaft and inclined with respect to the axis of the shaft. The shaft 1 and blades 2 are integrally formed from a ceramic material by injection molding. Examples of the material are such nitrides as $Si_3N_4$, AlN and TiN, such oxynitrides as $Si_2ON_2$ and SiAlON, such carbides as SiC, $B_4C$, TiC and ZrC, such carbonitrides as $Si_3N_4$-SiC and such oxides as $Al_2O_3$, $ZrO_2$ and $MgAlO_2$. The injection molding is done using a mold, which has parting lines corresponding to the edges of the blades, so that a molding having projections 5 formed on the edges of the blades 2 is obtained. As shown in FIG. 2, each projection 5 has a substantially triangular cross section and is about 0.5–1.0 mm high and wide. The molding thus obtained is then sintered, and projections 5 formed on blade edges (6) facing a casing (not shown) are removed by grinding while leaving projections 5 formed on inlet and outlet edges 3 and 4 of the blades 2 facing a passage of fluid such as combustion exhaust gas (the direction of flow of fluid being shown by arrows). The numeral 7 is a shaft connected to the shaft 1.

The radial flow turbine rotor of the above construction, which is a one-piece sintered ceramic body having the shaft and blades formed intergrally by injection molding, has high mechanical strength at high temperatures. Also, its specific weight is low so that it is light in weight. Thus, its blade stems will not be broken due to vibration stress or rotational moment. Further, since the projections are formed on the blade edges facing the fluid passage and a fluid is guided along the projections, the loss of fluid energy can be reduced to increase turbine efficiency. Further, since the injection molding is done using a mold which has parting lines corresponding to the blade edges, no burrs are formed on the periphery of the shaft, so that only the edges of the blades that are facing the casing can be ground after sintering. Thus, the time required for grinding can be greatly reduced.

Now, a specific example of the method of manufacture according to the invention will be described. A powder mixture consisting of 84% by weight of silicon nitride, 6% by weight of yttrium oxide and 10% by weight of aluminum oxide, the mean particle size thereof being 1.1, 1.2 and 0.5 microns respectively, was used. For the binder a thermoplastic organic material was used. The proportion of the organic binder should be as small as possible for it must be removed in the subsequent step. Generally, the volume ratio of the ceramic material to the organic binder ranges from about 70:30 to 50:50. In this example, it was set at 60:40. The ceramic material and binder were kneaded together while heating the system to a temperature of about 150° at which the binder was fused. The paste thus obtained was used for injection molding with an injection pressure of about 500 kg/cm$^2$. The injection pressure desirably ranges from about 50 to 1,000 kg/cm$^2$. After injection molding, the molding was gradually heated to remove the binder through decomposition and evaporation. At this time, deformation of the molding and formation of cracks in the molding are prone, if the rate of temperature rise is low. For this reason, it is desirable to raise the temperature to about 500° to 1,200° C. at a rate of about 0.5° to 20° C./hr. In this example, the heating was done at a rate of about 5° C./hr to raise the temperature to about 800° C. After the binder had been completely removed, sintering was done. Sintering is desirably done by heating the molding in an inert gas such as nitrogen gas at a temperature of about 1,650° to 1,800° C. to prevent oxidation. In this example, the sintering was done by holding the molding in a nitrogen gas at about 1,750° C. for four hours. After sintering, the blade edges which are facing the casing were ground with a #200 diamond grindstone to obtain the product. The grindstone usually has a grain size ranging from #100 to #600.

The specific gravity and the liner thermal expansion coefficient of the ceramic materials obtained were 3.20 g/cc and $3.1\times10^{-6}$/°C. respectively. The flexural strengths were 75 kg/mm$^2$ at room temperature, 75 kg/mm$^2$ at 700° C. and 71 kg/mm$^2$ at 1,000° C.

In this example, the radial flow turbine rotor made by this example helps enhance the turbine efficiency. Further the grinding time after the sintering was reduced to one half compared to the prior art method of manufacture.

What we claim is:

1. A method of manufacturing a radial flow turbine rotor for a radial flow turbine of the type having a casing defining inlet and outlet fluid passageways, said method comprising the steps of injection molding a rotor body including a conical shaft and a plurality of blades formed on the periphery of said shaft and at an angle to the axis of said shaft from a ceramic material using a mold having parting lines corresponding to edges of the blades, allowing projections to be formed on the blade edges corresponding to the mold parting lines, sintering the molding thus obtained, and grinding the edge surfaces of said blades to remove only those portions of the formed projections to be placed adjacent the casing thereby leaving other portions of the formed projections to be placed in confronting relationship to the inlet and outlet passageways.

2. A method according to claim 1, wherein said sintering step is furnace sintering.

3. A method according to claim 1 or 2, wherein said ceramic material is silicon nitride.

4. A method according to claim 1 or 2, wherein said ceramic material is silicon carbide.

5. A method according to claim 1 or 2, wherein said ceramic material is silicon aluminum oxynitride.

* * * * *